US007731343B2

(12) United States Patent
Zhang

(10) Patent No.: US 7,731,343 B2
(45) Date of Patent: Jun. 8, 2010

(54) NEGATIVE PRESSURE INK SUPPLY SYSTEM

(75) Inventor: Wenyuan Zhang, Wenzhou (CN)

(73) Assignee: Zhejiang Gongzheng Technology Development Co., Ltd., Wenzhou, Zhejiang Province (CN)

( * ) Notice: Subject to any disclaimer, the term of this patent is extended or adjusted under 35 U.S.C. 154(b) by 771 days.

(21) Appl. No.: 11/553,109

(22) Filed: Oct. 26, 2006

(65) Prior Publication Data

US 2008/0036825 A1 Feb. 14, 2008

(30) Foreign Application Priority Data

Aug. 14, 2006 (CN) ..... 2006 2 0044864 U

(51) Int. Cl.
*B41J 2/175* (2006.01)
*B41J 2/17* (2006.01)

(52) U.S. Cl. ..... 347/85; 347/84

(58) Field of Classification Search ..... 347/2, 347/3, 4, 85, 6, 7, 84, 22, 28; 141/114, 351
See application file for complete search history.

(56) References Cited

U.S. PATENT DOCUMENTS 4,249,187 A * 2/1981 Erikson et al. ..... 347/4
5,751,319 A * 5/1998 Robertson et al. ..... 347/85
5,877,793 A * 3/1999 Erickson ..... 347/85
7,484,838 B2 * 2/2009 Tsurui et al. ..... 347/86
2006/0152560 A1 * 7/2006 Samii et al. ..... 347/85
2007/0024682 A1 * 2/2007 Inoue ..... 347/85
2007/0247497 A1 * 10/2007 Buchanan et al. ..... 347/85

* cited by examiner

*Primary Examiner*—Stephen D Meier
*Assistant Examiner*—Rene Garcia, Jr.
(74) *Attorney, Agent, or Firm*—Global IP Services; Tianhua Gu

(57) ABSTRACT

A negative pressure ink supply system includes (1) a primary ink cartridges, (2) a secondary ink cartridges, which are connected by means of an ink tubes with the negative pressure ink cartridge assemblies provided between the secondary ink cartridges and the jet head. The ink, pumped from the primary ink cartridge, is put into the secondary ink cartridge, wherein it is supplied to the negative pressure ink cartridge and then in turn from the negative pressure ink cartridge to the jet head. The liquid level in the secondary cartridge is lower than the jet head surface and adjustable. The negative pressure ink supply system is suitable for image-printing equipment by supplying liquid ink, such as large format machines, portrait machines, plotters, etc.

9 Claims, 4 Drawing Sheets

NEGATIVE PRESSURE INK SUPPLY SYSTEM

FIELD OF THE INVENTION

This invention relates to a negative pressure ink supply system, it is suitable for supplying liquid ink to image-printing equipments, such as large format printers, portrait printers, plotters, etc.

BACKGROUND OF THE INVENTION

At present, the ink supply devices used on the image printing equipment for supplying a liquid ink, such as large/digital format printers, portrait printers, plotters, etc., fall into two categories: a basket type of ink supply system and a vacuum pump type of ink supply system.

For the basket type, the ink, sucked by an ink pump from the primary (bigger) ink cartridge, is fed through a filter to the secondary ink cartridge, which follows the motion of the jet head and in which the liquid level, 30 mm~70 mm lower than the jet head position and adjustable, is controlled by an inside level control switch (a float ball).

Advantageously, the basket type of ink supply system is easy in manufacture and low at price with adjustable negative pressure values for each color.

Disadvantageously, the system is incapable of printing materials like plane plates as the small basket has to be lower than the jet head operating platform; not able to clean the jet head rapidly; unstable of the negative pressure value at the jet head surface resulting from a long tube from the secondary ink cartridge to the jet head. Besides, with the carriage under a reciprocate motion, its secondary ink cartridge is apt to leak.

For the vacuum pump type ink supply system, in a position higher than the jet head is arranged the secondary ink cartridge, in which are provided a liquid level switch for liquid level control and a negative pressure sensor for control over air extract from this cartridge by the vacuum pump so as to keep the inside air pressure negative.

Advantageously, the vacuum pump type ink supply system is capable of printing materials in the form of plane plates owing to stable negative pressure values on the jet head surface, and disadvantageously, contains a large numbers of parts and components, the key parts of which have to be imported, its manufacture and test are difficult and expensive. The equipment requires skillful technician trained specially. Besides, it is not easy to adjust negative pressure values for each color or have a rapid jet head cleaning.

SUMMARY OF THE INVENTION

The object of this invention is to provide a negative pressure ink supply system, which has eliminated the above described defects of both basket and vacuum pump types of negative pressure ink supply systems.

To achieve the above purpose, a three-stage ink supply system based on physically negative pressure is adopted for the negative pressure ink supply system in accordance with the present invention. The negative pressure ink supply system comprises a primary ink cartridge, secondary ink cartridge, a jet head, and a negative pressure ink cartridge assembly arranged between the secondary ink cartridge and the jet head. The secondary ink cartridge is connected, by means of an ink tube, with a negative pressure ink cartridge of the negative pressure ink cartridge assembly; the negative pressure ink cartridge is connected with the jet head. The ink, pumped from the primary ink cartridge, is put into the secondary ink cartridge, wherefrom it is supplied to the negative pressure ink cartridge and then in turn from the negative pressure ink cartridge to the jet head. The liquid level in the secondary ink cartridge is lower than the jet head surface and adjustable.

The negative pressure ink cartridge assembly adopted in the ink supply system in accordance with the present invention comprises negative pressure ink cartridges, screw plugs, feed-through links, joints at the ink inlets, tee valves, cleaning solution tubes and ink jet tubes with the last three arranged at the outlet of the negative pressure ink cartridge. The screw plug is used in combination with the air extraction opening to the negative pressure ink cartridge on which are provided orifices through which ink enters the negative pressure ink cartridge.

The negative pressure ink supply system in accordance the present invention has the following advantages: low price, simple structure, easy use, low requirements for users, capability to print plane plates, stable negative pressure on the jet head surface, negative pressure adjustable for each color of ink, short ink supply tube, little air bubbles produced between the negative pressure ink cartridge and the jet head, ink economizing upon printer cleaning, rapid jet head cleaning, 30~80% ink and cleaning water economizing in the process of utilization, lowered quality requirements for ink, eased temperature requirements for ink and lowed requirements for tension coefficients on the ink surface.

BRIEF DESCRIPTION OF THE DRAWINGS

The invention is further illustrated, by way of example, with reference to the accompanying drawings, in which

FIG. 5 is a schematic diagram of a tee valve spool position with ink on.

FIG. 6 is a schematic diagram of a tee valve spool position with cleaning solution on.

The reference number in the above figures and their designation: 1: primary ink cartridge, 2: filter, 3: ink pump, 4: fixed mount for secondary ink cartridge, 5: secondary ink cartridge, 6: liquid level control switch, 7: air filter, 8: ink tube, 9: negative pressure ink cartridge assembly, 10: carriage, 11: jet head, 12: screw plug, 13: cleaning solution tubes, 14: jet head ink tube, 15: outlet, 16: negative pressure ink cartridge, 17: orifice, 18: valve spool assembly, 19: feed-through link, 20: joint at ink inlet, 21: tee valve, 22: ink cartridge cover, 23: ink cartridge connector, and 24: sealing film.

DETAILED DESCRIPTION OF THE INVENTION

Figure 1:
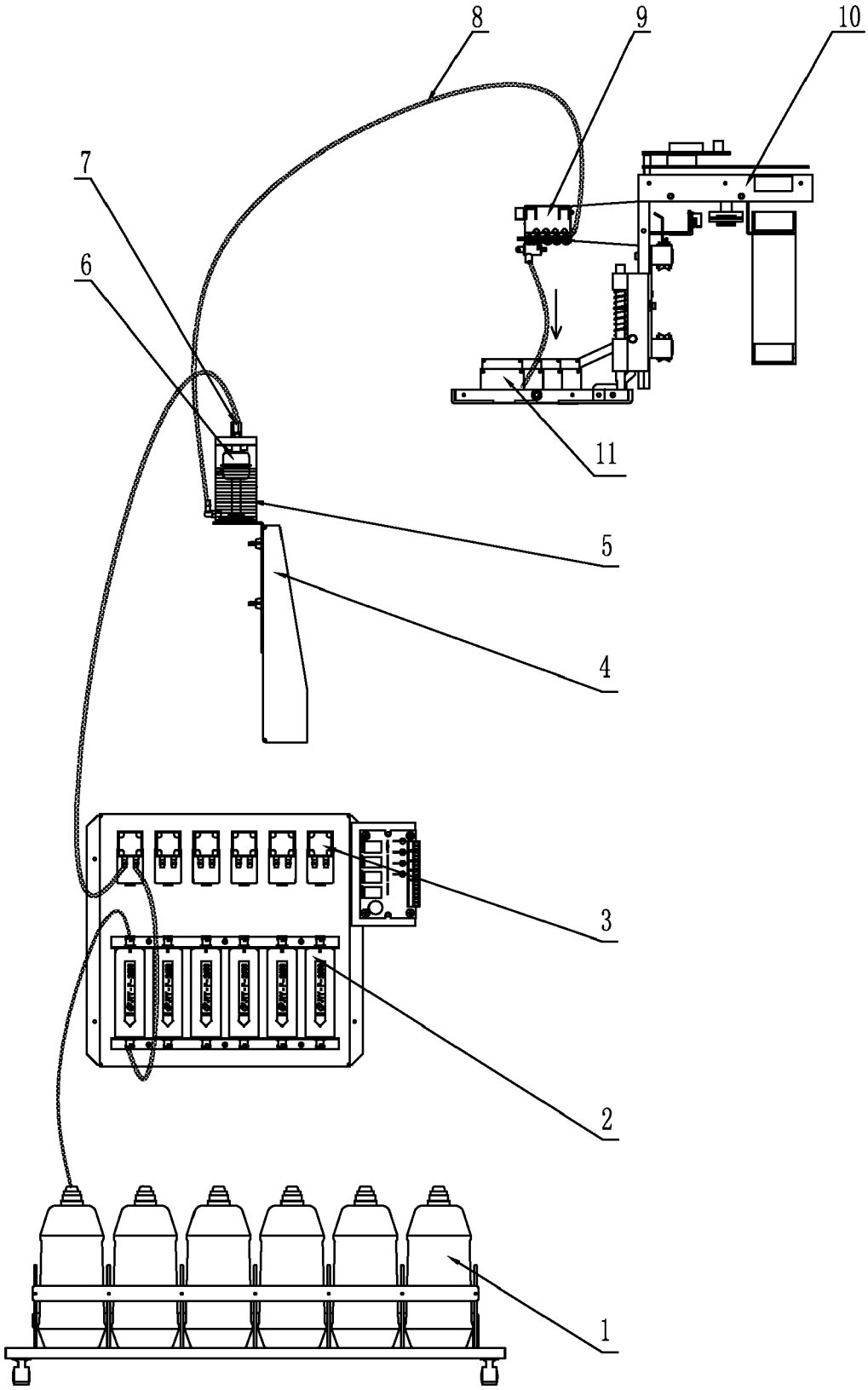
FIG. 1 is a schematic diagram of the overall structure of the negative pressure ink supply system of the present invention.
Figure 2:
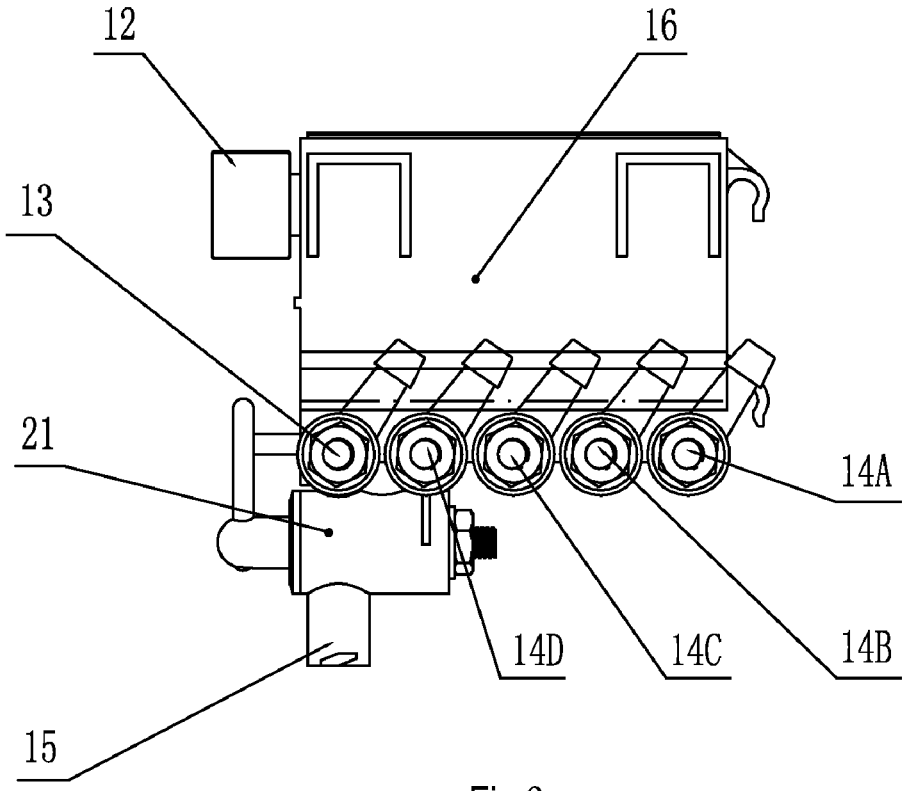
FIG. 2 is a schematic diagram of the overall structure of the negative pressure ink cartridge assembly.
Figure 3:
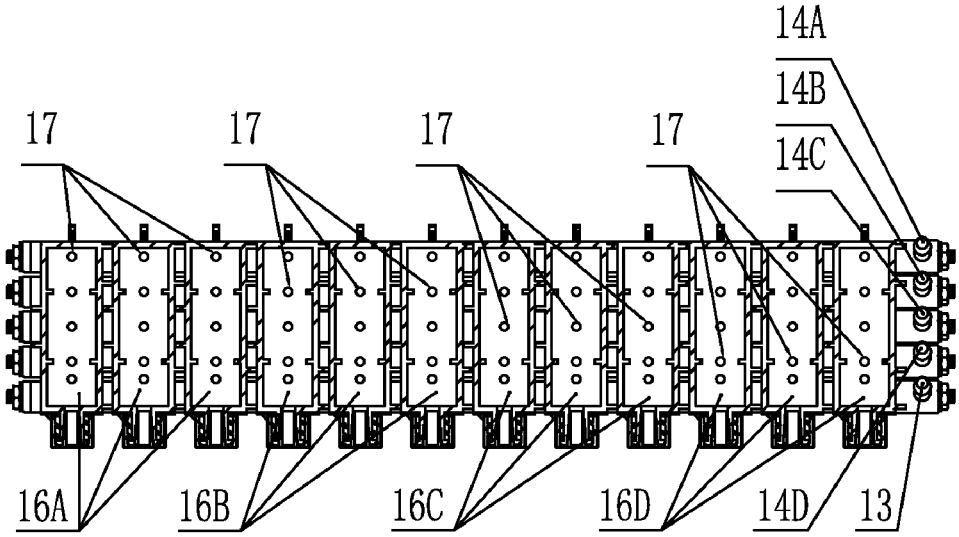
FIG. 3 is a schematic diagram of four sets of negative pressure ink cartridge.
Figure 4:
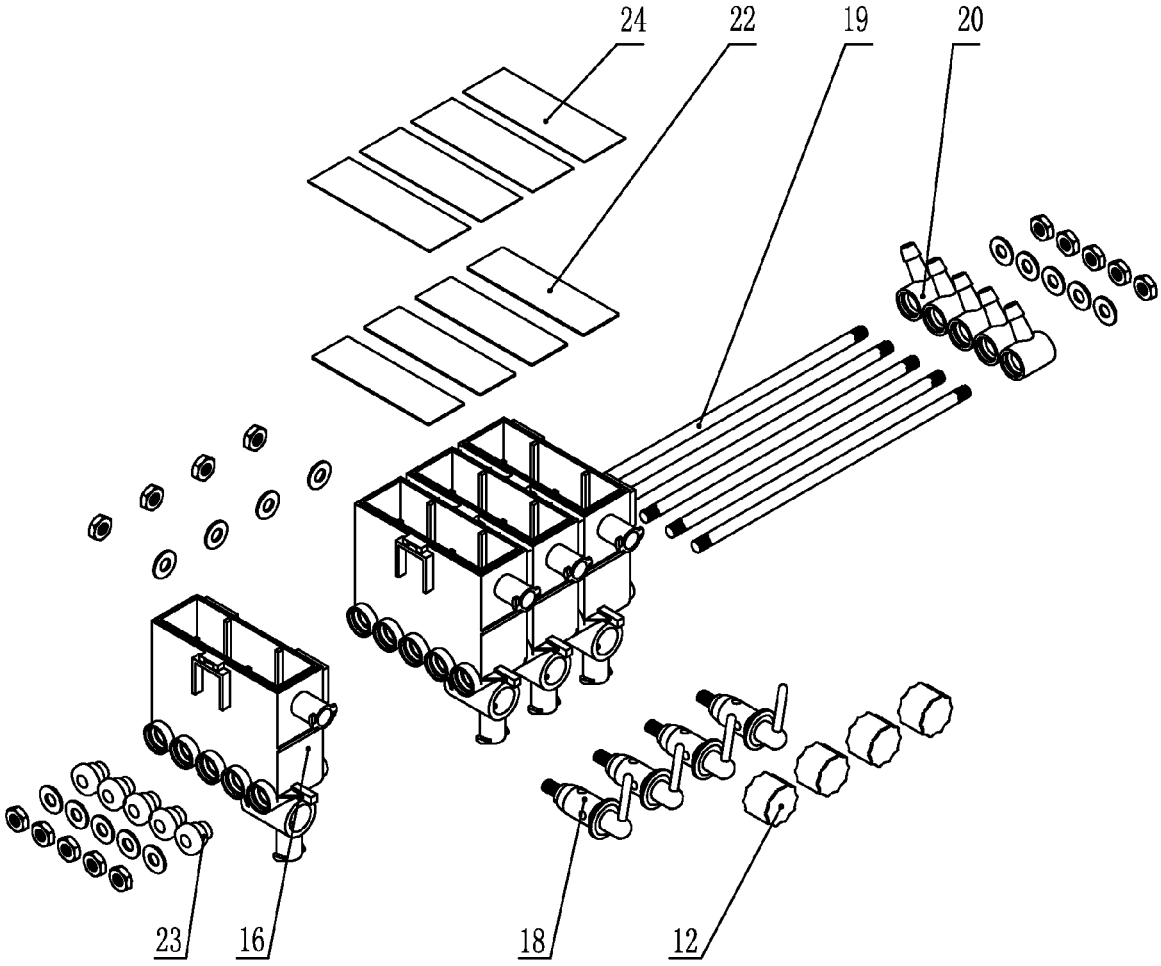
FIG. 4 is a dismantling diagram of the negative pressure ink cartridge assembly.

As shown in FIGS. 1 and 2, in an embodiment in accordance with the present invention, a negative pressure ink supply system with four sets of negative pressure ink cartridges 16A, 16B, 16C and 16D in black, blue, red and yellow respectively, and a set of cleaning solution tubes comprises primary ink cartridges 1, secondary ink cartridges 5, filters 2, ink pumps 3, negative pressure ink cartridge assemblies 9 and jet heads 11. A liquid level switch control 6 for liquid level control and air filter 7 are provided inside the secondary ink cartridge 5 arranged on the fixed mount 4. A negative pressure ink supply assembly 9 is fixed on the carriage 10, and the jet head 11 is generally 30~70 mm higher than the ink level inside the secondary ink cartridge 5. A float switch is generally employed as a liquid level control switch 6 and adopted in the present embodiment. The air filter is used for purifying the impurities in the air to prevent them from contaminating ink. The negative pressure ink cartridge assembly 9 includes negative pressure ink cartridges 16, screw plugs 12, feed-through links 19, joints at ink inlet 20, tee valves 21, cleaning solution tubes 13 and the jet head ink tubes 14 which consists of four sets of ink tube 14A, 14B, 14C and 14D respectively in black, blue, red and yellow. The cleaning solution tube 13, jet head ink tubes 14 and tee valve 21 are arranged at the outlet of negative pressure ink cartridge 16, at the top of which is provided the screw plug 12, which is used in conjunction with the air extract opening of the negative pressure ink cartridge 16, on which orifices 17 are provided. The ink outlet of the secondary ink cartridge 5 is connected, through ink tube 8 and ink inlet joint 20, with the negative pressure ink cartridge 16, the outlet 15 of which is linked to jet head 11. Ink flows into the negative pressure ink cartridge 16 through the orifices 17 on its surface after passing through primary ink cartridge, secondary ink cartridge 5, ink tube 8, the gap between the feed-through link 19 and negative pressure ink cartridge 16. The feed-through link 14 is used to facilitate the passing of ink or cleaning solution and the assembling of several sets of ink cartridges.

Figure 5:
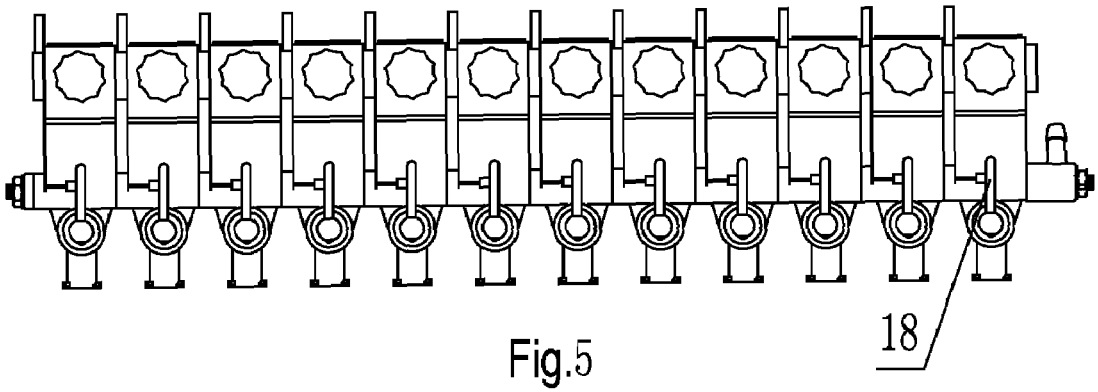

With the first set of ink cartridge as an example, the operating process of the negative pressure ink supply system is illustrated as follows:

As shown in FIG. 5, with the spool 18 of the tee valve 21 turned to the ink-on status with the spool handle put in the vertical direction, ink is pumped by the ink pump 3 from the primary ink cartridge 1 and put, through filter 2, into the secondary ink cartridge 5 arranged on the fixed mount 4. Upon an ink supply to the secondary ink cartridge for the first time, the ink is pumped by ink pump 3 to the secondary ink cartridge 5, wherein the ink is controlled by the float switch 6 inside the secondary ink cartridge 5. As the float 6 reaches a certain level and the ink pump 3 stops operation, remove the screw plug 12 from the air extract opening of the negative pressure ink cartridge 16 and have the air in the negative pressure ink cartridge 16 extracted with an injector. Then reassemble the screw plug 12. At this time, the pressure in the negative pressure ink cartridge 16 is at a −H mercury column level (negative pressure). As the ink tube 8 connecting the negative pressure ink cartridge 16 with the secondary ink cartridge 5 is sealed and the second ink cartridge 5 is open to outside through the air filter 7, the pressure difference between the second ink cartridge 5 and the negative pressure ink cartridge 16 forces the ink into the negative pressure ink cartridge 16 through the ink tube 8, the gap between the feed-through link 19, negative pressure ink cartridge 16, and the orifices 17. Then the ink flows, through the tee valve 21 of the negative pressure ink cartridge 16, from the outlet 15 under the ink cartridge 16 to the jet head 11 and is sprayed from the jet head 11 by the self-priming of 11. Images are produced by the scanning of the jet head. With the ink in the secondary ink cartridge 5 flowing incessantly into the negative pressure ink cartridge 16, the float 6 falls gradually. As the float 6 comes to a certain level, the ink pump 3 begins to work again, pumping the ink into the secondary ink cartridge 5. The position of the jet head 11 is higher than the ink level of the secondary ink cartridge 5. Once the jet holes in a very small diameter in the jet head 11 are filled with ink, a concave surface will be formed by the surface tension of the ink molecules, preventing the ink from flowing upwards to the negative pressure ink cartridge 16, thereby, no negative pressure will be produced. As a matter of fact, the residual air in the negative pressure ink cartridge 16 acts as something like a pullback spring. When the jet head 11 under operation is spraying ink, the ink level inside the negative pressure ink cartridge 16 will gradually fall, and as both the negative pressure ink cartridge 16 and the pipeline from the jet head 11 to the secondary ink cartridge 5 are sealed, the space inside 16 is increasing, resulting in the gradually-augmenting inside negative pressure values, which will cause the air outside of the ink supply system to exert a pressure, through the air filter 7 of the secondary ink cartridge 5, on the ink inside the secondary ink cartridge and force the ink to flow again into the negative pressure ink cartridge 16 through the ink tube 8. With the jet head operating, ink is supplied consecutively in the above way.

Figure 6:
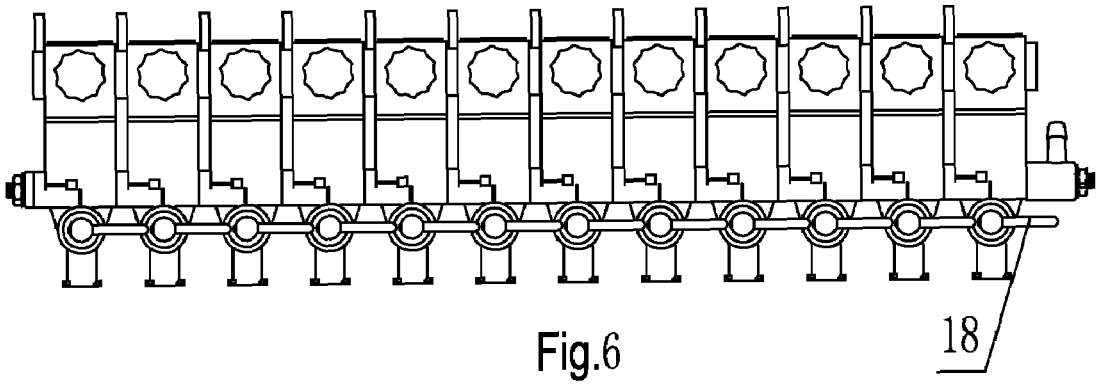

As shown in FIG. 6, as the spool 18 of the tee valve 21 is turned to the direction for closing the ink tube and opening the cleaning solution tube (with the spool handle in a horizontal position), the cleaning solution flows, through the gap between the feed-through link 19 and the negative pressure ink cartridge 16, and also the outlet of the 16, towards the jet head 11 for its cleaning.

Figure 7:
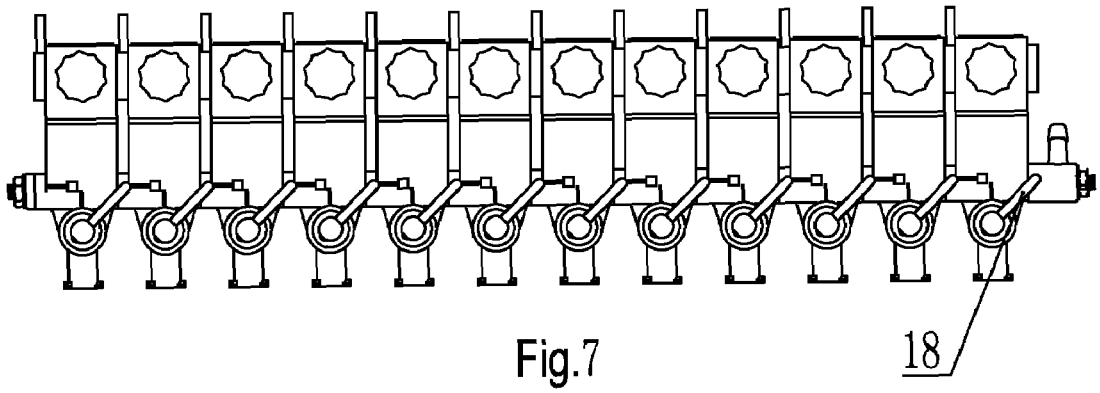
FIG. 7 is a schematic diagram of a tee valve spool position with both ink and cleaning solution off.

FIG. 7 shows the position of the spool 18 handle with both the ink tube and the cleaning solution tube fully closed.

The invention claimed is:

1. A negative pressure ink supply system comprising:

a plurality of primary ink cartridges;

a plurality of ink pumps;

a plurality of secondary ink cartridges;

a plurality of jet heads;

a negative pressure ink cartridge assembly having a plurality of negative pressure ink cartridges provided between the plurality of secondary ink cartridges and the plurality of jet heads;

each corresponding primary ink cartridge, ink pump, secondary cartridge, negative pressure ink cartridge and jet head being connected in serious by ink tubes;

each liquid level in the plurality of secondary ink cartridges being lower than each surface of the plurality of jet heads and being adjustable;

each negative pressure ink cartridge having:

a tee valve, a cleaning solution tube and a jet head ink tube, which are located its outlet, a screw plug being set on top of the negative pressure ink cartridge and being used in conjunction with an air extract opening of the negative pressure ink cartridge, a feed-through link being used to facilitate passing of ink or cleaning solution and to assemble the plurality of negative pressure ink cartridges together;

a joint of ink inlet for the ink tube connecting the negative pressure ink cartridge and the secondary ink cartridge; and an orifice is provided on a surface of the negative pressure ink cartridge.

2. The negative pressure ink supply system as claimed in claim 1, wherein the plurality of negative pressure ink cartridges is connected together by feed-through links.

3. The negative pressure ink supply system as claimed in claim 1, wherein the screw plug and the air extract opening are used for making negative pressure in the negative pressure ink cartridge at beginning of supplying ink to it.

4. The negative pressure ink supply system as claimed in claim 1, wherein the orifice provided on each negative pressure ink cartridge is for ink flowing into other negative pressure ink cartridges.

5. The negative pressure ink supply system as claimed in claim 1, wherein each secondary ink cartridge includes a float switch for controlling ink level and an air filter for cleaning air sucked into the secondary ink cartridge.

6. The negative pressure ink supply system as claimed in claim 5, wherein the float switch is a float ball.

7. The negative pressure ink supply system as claimed in claim 1, wherein each ink pump is incorporated an ink filter for cleaning ink.

8. The negative pressure ink supply system as claimed in claim 1, wherein each secondary ink cartridge is lower than a surface of each jet head 30 mm to 70 mm.

9. The negative pressure ink supply system as claimed in claim 1, wherein ink is pumped by the plurality of ink pumps from the plurality of primary ink cartridges and put into the plurality of secondary ink cartridges, the ink is controlled by a float switch, when it reaches a certain level and the ink pump stops operation, make the plurality of negative pressure ink cartridges at a negative pressure, as the plurality of second ink cartridges is open to outside, the pressure difference between the second plurality of ink cartridges and the plurality of negative pressure ink cartridges forces the ink into the plurality of negative pressure ink cartridges, then to the plurality of jet heads, when the plurality of jet heads is spraying ink, the ink level inside the plurality of negative pressure ink cartridges will gradually fall, resulting in the gradually-augmenting negative pressure values inside the plurality of negative pressure ink cartridges, which will cause the air outside to exert a pressure, on the ink inside the plurality of secondary ink cartridges and force the ink to flow again into the plurality of negative pressure ink cartridges, ink is supplied consecutively in the above way.

* * * * *